US008333086B2

(12) United States Patent
Fujisawa et al.

(10) Patent No.: US 8,333,086 B2
(45) Date of Patent: Dec. 18, 2012

(54) CONDENSER AND COOLING DEVICE

(75) Inventors: Ryo Fujisawa, Kobe (JP); Kazuto Okada, Kobe (JP); Masatake Toshima, Kobe (JP); Yoshihiro Nakayama, Takasago (JP); Koichiro Iizuka, Takasago (JP); Satoshi Ide, Takasago (JP); Kunihiko Suto, Tokyo (JP); Kazutaka Kurashige, Tokyo (JP); Ichirou Sakuraba, Nagoya (JP); Daisuke Hayashi, Nagoya (JP); Shinji Shato, Amagasaki (JP); Masaki Ikeuchi, Amagasaki (JP); Hans Madsboll, Taastrup (DK); Christian Svarregaard-Jensen, Hojbjerg (DK)

(73) Assignees: The Tokyo Electric Power Company, Incorporated, Chiyoda-ku (JP); Chubu Electric Power Co., Inc., Higashi-ku (JP); Kansai Electric Power Co., Inc., Osaka-shi (JP); Kobe Steel, Ltd., Kobe-shi (JP); Danish Technological Institute, Taastrup (DK); Johnson Controls Denmark APS, Hojbjerg (DK)

( * ) Notice: Subject to any disclaimer, the term of this patent is extended or adjusted under 35 U.S.C. 154(b) by 346 days.

(21) Appl. No.: 12/734,753

(22) PCT Filed: Nov. 20, 2008

(86) PCT No.: PCT/JP2008/071149
§ 371 (c)(1),
(2), (4) Date: Jul. 20, 2010

(87) PCT Pub. No.: WO2009/066738
PCT Pub. Date: May 28, 2009

(65) Prior Publication Data

US 2010/0293992 A1 Nov. 25, 2010

(30) Foreign Application Priority Data

Nov. 21, 2007 (JP) ..... 2007-302098

(51) Int. Cl.
*F28D 5/00* (2006.01)

(52) U.S. Cl. ..... 62/314

(58) Field of Classification Search ..... 62/314, 62/506, 515
See application file for complete search history.

(56) References Cited

U.S. PATENT DOCUMENTS

| | | | | |
|---|---|---|---|---|
| 3,854,299 | A * | 12/1974 | Myers et al. | 62/534 |
| 4,122,688 | A * | 10/1978 | Mochizuki et al. | 62/196.1 |
| 4,953,361 | A * | 9/1990 | Knoche et al. | 62/79 |
| 6,755,043 | B2 | 6/2004 | Jensen et al. | |
| 2003/0150233 | A1 | 8/2003 | Jensen et al. | |

FOREIGN PATENT DOCUMENTS

| | | |
|---|---|---|
| JP | 60-165777 | 11/1985 |
| JP | 63-225764 | 9/1988 |
| JP | 2002-267094 | 9/2002 |
| JP | 2003-534519 | 11/2003 |

* cited by examiner

OTHER PUBLICATIONS

International Search Report for PCT/JP2008/071149, dated Feb. 17, 2009.

*Primary Examiner* — Melvin Jones
(74) *Attorney, Agent, or Firm* — Stites & Harbison, PLLC; Juan Carlos A. Marquez, Esq

(57) ABSTRACT

In the condenser provided with two of the degassing chambers separated by a cooling fluid, communication between the degassing chambers is prevented even if a pressure difference is increased between the degassing chambers. The condenser has the housing having the vapor inflow port connectable to the discharge portion of the compressor, the first degassing chamber, in the housing, communicating with the vapor inflow port, and the second degassing chamber, in the housing, arranged above the first degassing chamber across the partition portion, and the passing portion for permitting a cooling fluid to flow from the second degassing chamber to the first degassing chamber, wherein the first degassing chamber is separated from the second degassing chamber by the cooling fluid in the passing portion, and the passing portion has a pressure head space for containing a specified volume of cooling fluid so as to absorb a variation in a pressure difference between the first degassing chamber and the second degassing chamber.

7 Claims, 4 Drawing Sheets

CONDENSER AND COOLING DEVICE

TECHNICAL FIELD

The present invention relates to a condenser and cooling device.

BACKGROUND ART

Conventional condensers for use in various kinds of cooling devices which generate cold water and ice have been known. For example, Patent Document 1 below discloses an example of such condensers. The condenser according to Patent Document 1 is connected to a discharge portion of a compressor, and an evaporator is connected to a suction portion of the compressor, where vapor generated when cold water is cooled down in the evaporator is sent to the condenser by the compressor in order to condense the vapor in the condenser. The condenser is configured to shed cooling water from an upper space in its housing in a shower form, and cause the vapor to adhere to the cooling water which turned into a mist in a lower space in order to condense the vapor. The condenser is provided with a degassing mechanism in order to improve condensation efficiency of vapor.

That is, if much air is included in cooling water to be shed in the housing, the air will hinder condensation of vapor adhering to the cooling water, so that air content of the cooling water is decreased by degassing air in the housing by a degassing mechanism. To be more specific, a plurality of degassing chambers vertically divided by a screen plate is provided in the housing. Cooling water shed from an upper space in the housing is accumulated on the screen plate in the upper degassing chamber to form a water film which separates the upper and lower degassing chambers from one another, and the cooling water is shed in the lower degassing chamber in a shower form by passing through fine holes of the screen plate. The condenser is provided with a first degassing device for discharging air degassed from the lower degassing chamber to the upper degassing chamber, and a second degassing device for externally exhausting air degassed from the upper degassing chamber. The first degassing device concentrates air by removing water contained in air degassed from the lower degassing chamber in order to discharge the air to the upper degassing chamber, while the second degassing device further concentrates air by removing water contained in air degassed from the upper degassing chamber in order to externally exhaust the air. Air is thus concentrated and degassed in two stages by the first degassing device and the second degassing device, so that a load applied to each of the degassing devices is reduced.

In the above condenser disclosed in Patent Document 1, pressure in the lower degassing chamber is decreased when a temperature in the lower degassing chamber is decreased due to various kinds of causes such as an operation state of the compressor, where a pressure difference of the upper degassing chamber relative to the lower degassing chamber is increased. In this case, a water level of cooling water accumulated on the screen plate is decreased in the upper degassing chamber, where a water film of cooling water for separating the upper and lower degassing chambers from one another is removed, and there is the danger that the upper and lower degassing chambers will communicate with one another. If the upper and lower degassing chambers thus communicate with one another, the first degassing device for concentrating and discharging air from the lower degassing chamber to the upper degassing chamber stops functioning.

Patent Document 1: National Publication of Translated Version No. 2003-534519.

DISCLOSURE OF THE INVENTION

The present invention was achieved to solve the above problems, and an object thereof is, in a compressor including two degassing chambers separated by cooling fluid, to prevent communication of the degassing chambers even if a pressure difference is increased between the degassing chambers.

In order to achieve the above object, a condenser according to the present invention includes: a housing having a vapor inflow port connectable to a discharge portion of a compressor, a first degassing chamber, in the housing, communicating with the vapor inflow port, and a second degassing chamber, in the housing, arranged above the first degassing chamber across a partition portion; a first degassing device for degassing and concentrating air from the first degassing chamber and discharging the concentrated air to the second degassing chamber; and a second degassing device for degassing and concentrating air from the second degassing chamber and externally discharging the concentrated air, the condenser shedding a cooling fluid in the first degassing chamber via the second degassing chamber in the housing and causing vapor flowing into the first degassing chamber through the vapor inflow port to adhere to the cooling fluid so as to condense the vapor, wherein the condenser includes a passing portion for permitting the cooling fluid to flow from the second degassing chamber to the first degassing chamber; the first degassing chamber is separated from the second degassing chamber by the cooling fluid in the passing portion, and the passing portion has a pressure head space for containing a specified volume of cooling fluid so as to absorb a variation in a pressure difference between the first degassing chamber and the second degassing chamber.

BEST MODE FOR CARRYING OUT THE INVENTION

Figure 1:
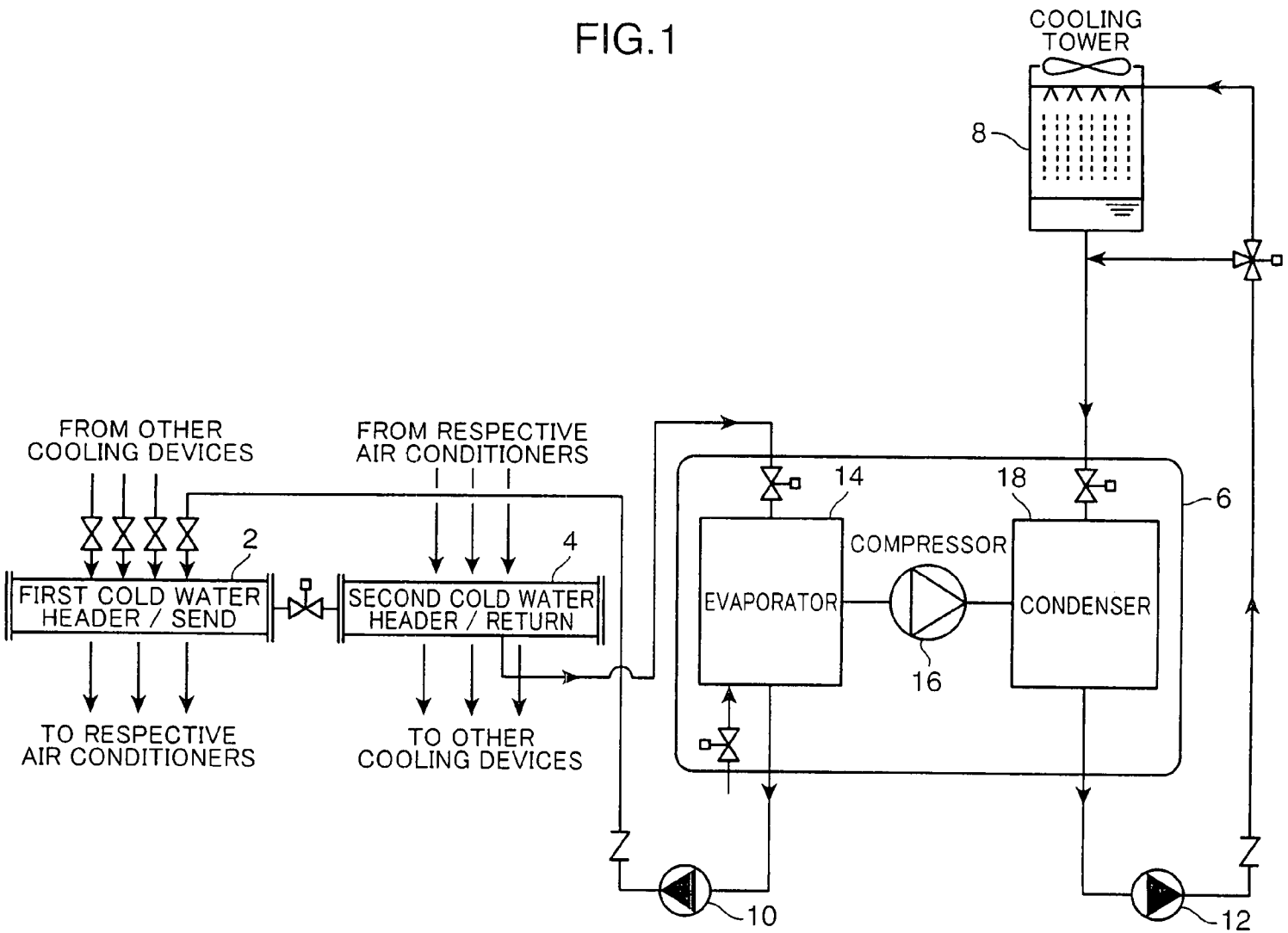
FIG. 1 is a fluid circuit diagram of a cooling device according to one embodiment of the present invention.

An embodiment of the present invention will be explained below referring to the drawings.

First, an entire configuration of a cooling device according to the present embodiment will be explained referring to FIG. 1.

The cooling device according to the present embodiment is used by being connected to an air conditioner, where cold water heated by heat exchange in the air conditioner is cooled down and supplied to the air conditioner again. The cooling device is provided with a first cold water header 2, second cold water header 4, cooling device main body 6, cooling tower 8, first pump 10, and second pump 12.

The first cold water header 2 receives cold water sent from other cooling devices not shown and cold water sent from the cooling device main body 6 so as to supply the cold water to air conditioners not shown. This cold water is included in the concept of a working fluid in the present invention.

The second cold water header 4 receives cold water returned from the air conditioners not shown so as to supply the cold water to the other cooling devices not shown and the cooling device main body 6.

The cooling device main body 6 has a function to cool down cold water returned from the air conditioners so as to supply the cold water to the air conditioners again. The cooling device main body 6 has an evaporator 14, a compressor 16, and a condenser 18.

Cold water sent from the second cold water header 4 is introduced to the evaporator 14. The evaporator 14 evaporates part of cold water in order to cool down the cold water by the evaporation heat. The first pump 10 is connected to the evaporator 14, where cold water which was cooled down is supplied from the evaporator 14 to the first cold water header 2 by driving the first pump 10.

The compressor 16 is connected between the evaporator 14 and the condenser 18. To be more specific, the evaporator 14 is connected to a suction portion of the compressor 16, while the condenser 18 is connected to a discharge portion of the compressor 16. The compressor 16 sucks and compresses water vapor generated at the time of cooling down cold water from the evaporator 14, and discharges the compressed water vapor to the condenser 18.

The condenser 18 cools down water vapor sent from the compressor 16 by using cooling water in order to condense the water vapor. The cooling water is included in the concept of a cooling fluid in the present invention. The condenser 18 is a heat exchanger of a direct heat exchange system, where water vapor sent from the compressor 16 is made to adhere to cooling water and condensed, as will be described later. A circulation path is configured to circulate cooling water around the condenser 18, the second pump 12 and the cooling tower 8. That is, cooling water which was heated up by condensing the water vapor in the condenser 18 is sent from the condenser 18 to the cooling tower 8 by driving the second pump 12. The cooling tower 8 cools down received cooling water which is returned to low temperatures and supplies the cooling water to the condenser 18. The condenser 18 condenses the water vapor by using cooling water returned from the cooing tower 8. A series of these processes are repeated among the condenser 18, second pump 12 and cooling tower 8.

Figure 3:
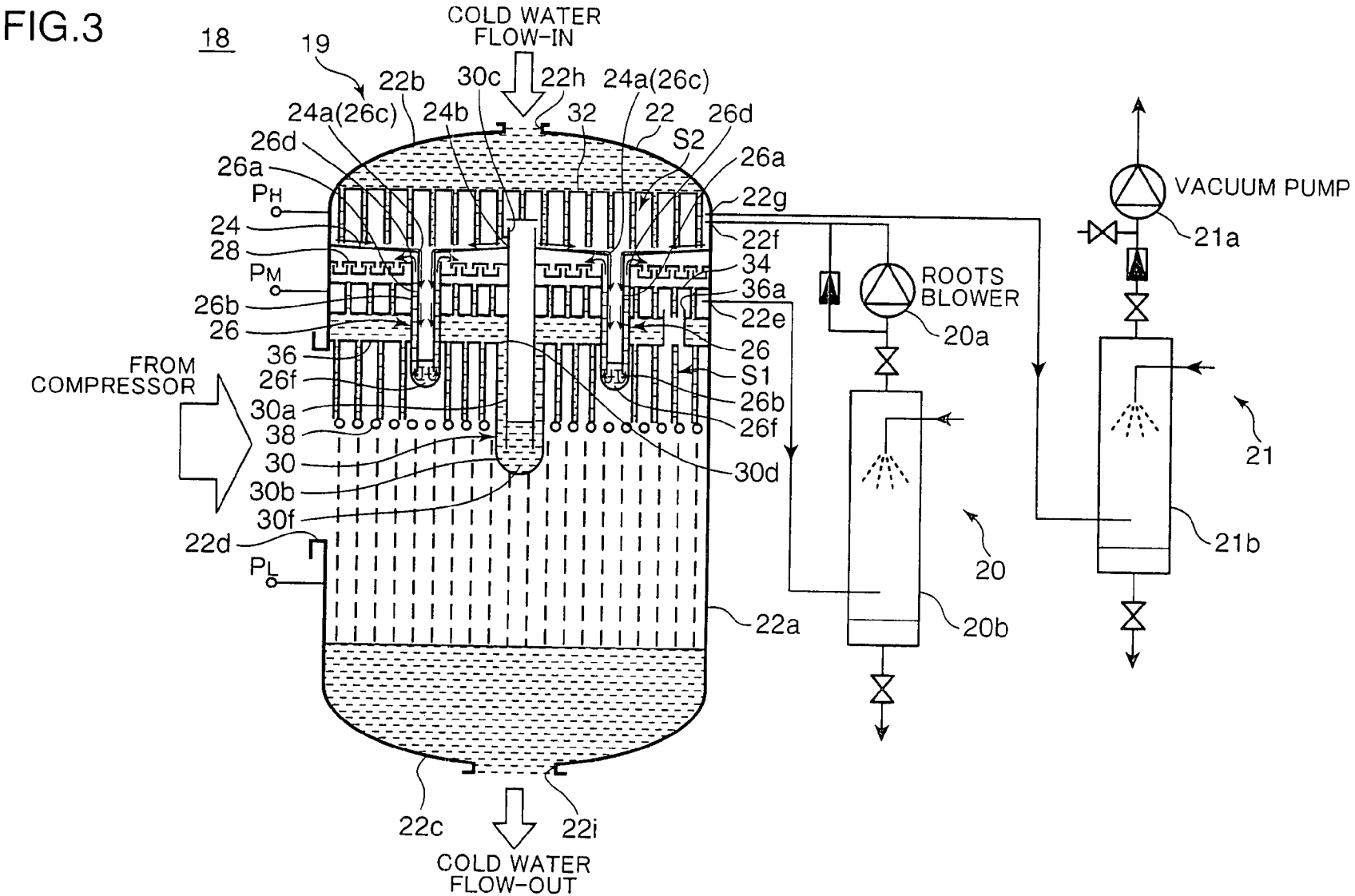
FIG. 3 is a diagram corresponding to FIG. 2 and showing the condenser in a state of having an increased pressure difference between a first degassing chamber and a second degassing chamber.
Figure 4:
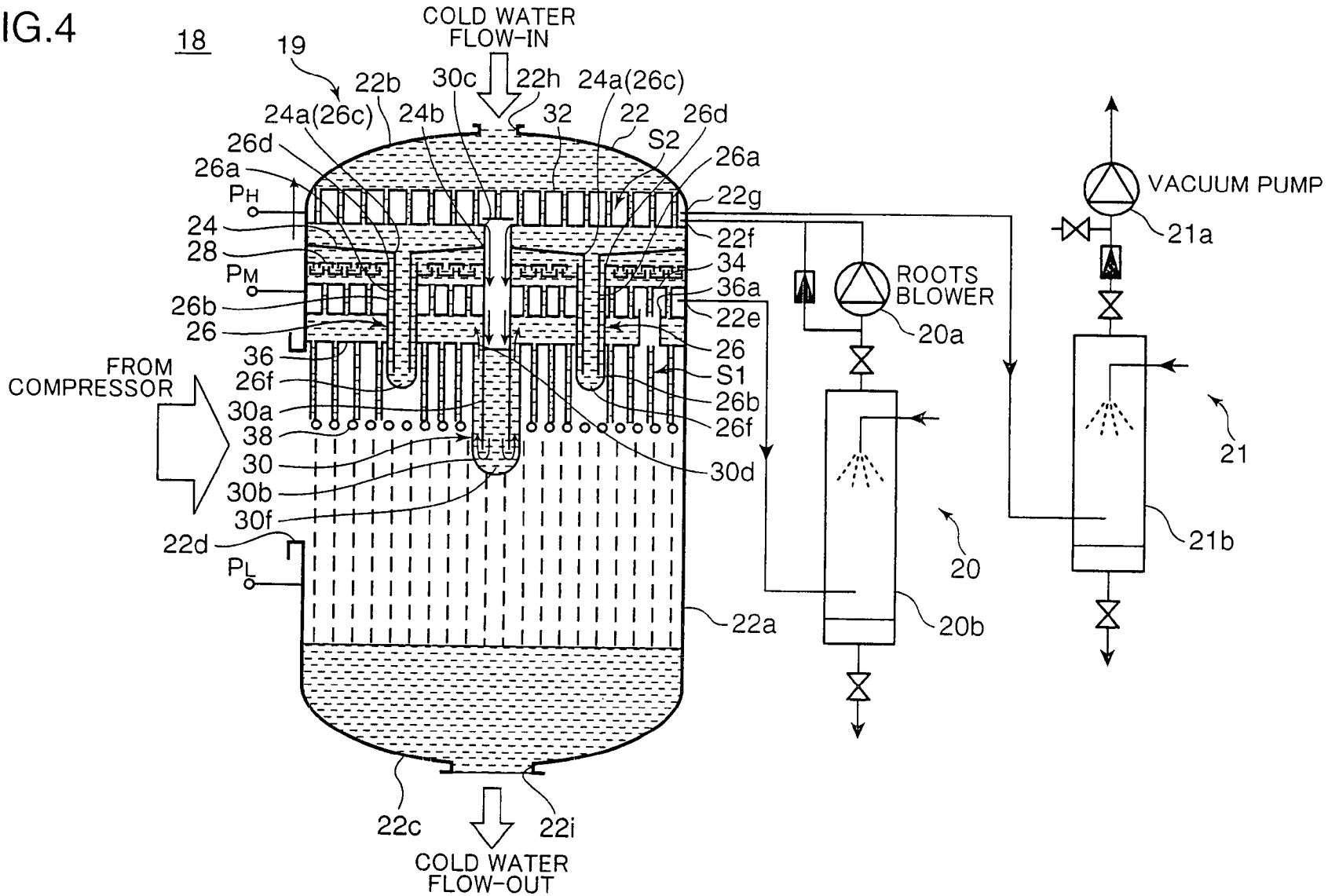
FIG. 4 is a diagram corresponding to FIG. 2 and showing the condenser in a state of having a decreased pressure difference between the first degassing chamber and the second degassing chamber.

A detailed configuration of the condenser 18 according to the present embodiment will be explained referring to FIGS. 2 to 4.

Figure 2:
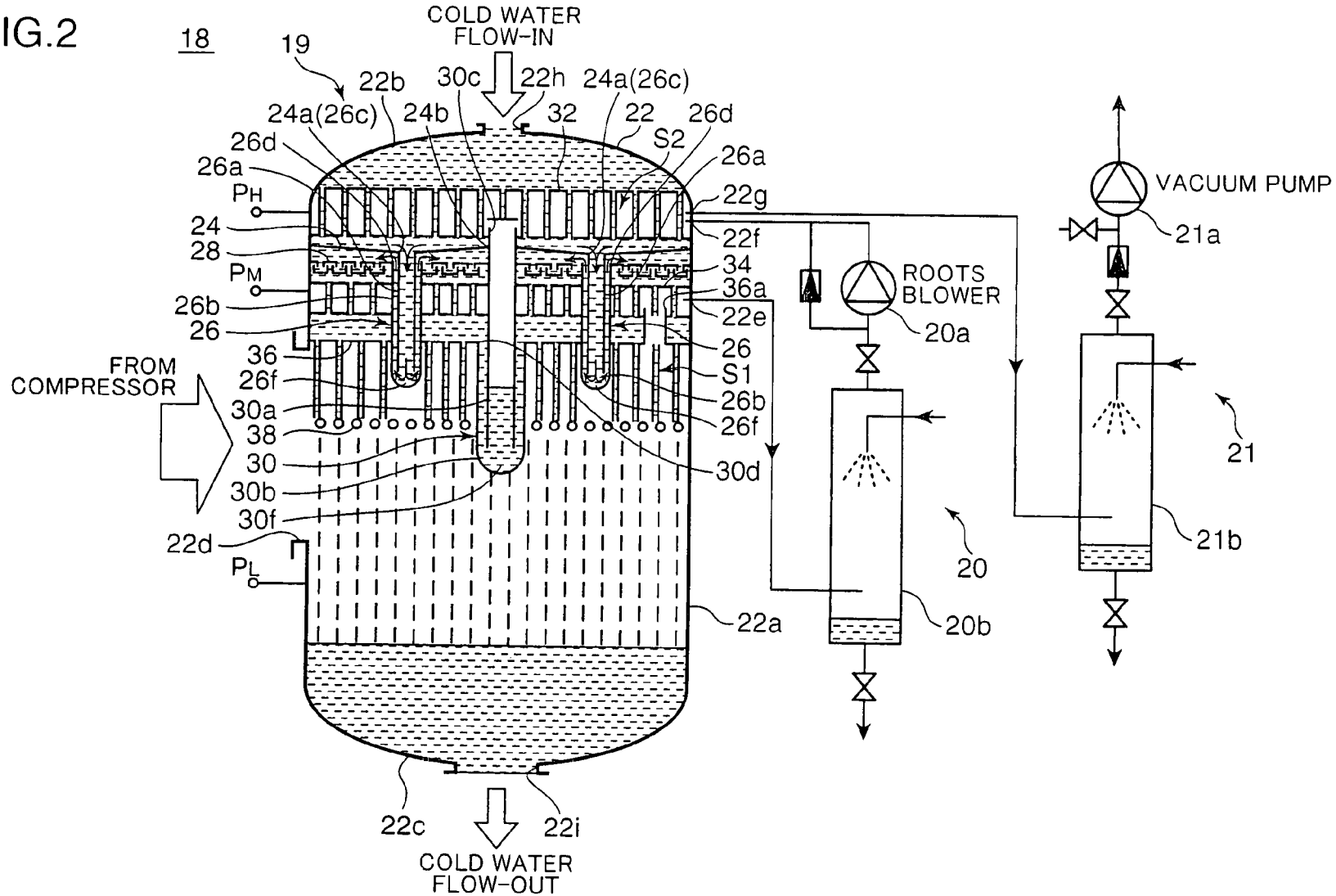
FIG. 2 is a diagram showing a configuration of a condenser applied to the cooling device shown in FIG. 1.

The condenser 18 according to the present embodiment has a condenser main body 19, a first degassing device 20, and a second degassing device 21 as shown in FIG. 2.

The condenser main body 19 is a body to condense water vapor discharged from the compressor 16 (refer to FIG. 1). The condenser main body 19 has a housing 22, partition portion 24, a plurality of passing portions 26, dispersion plate 28, bypass portion 30, first porous plate 32, second porous plate 34, third porous plate 36, and mesh member 38.

The housing 22 is configured by a side wall portion 22*a* of a cylindrical form having an axial center extending in the vertical direction, a top wall portion 22*b* for covering an opening in an upper end of the side wall portion 22*a*, and a bottom wall portion 22*c* for covering an opening in a lower end of the side wall portion 22*a*.

A vapor inflow port 22*d* is provided in a portion corresponding to a first degassing chamber S1, which will be described later, of the side wall portion 22*a*. The vapor inlet port 22*d* is connected to the discharge portion of the compressor 16. Water vapor discharged from the discharge portion of the compressor 16 flows into the hosing 22 through the vapor inflow port 22*d*. A first air outflow port 22*e* leading to a suction portion of the first degassing device 20 is provided in a portion corresponding to a space between the second porous plate 34 and the third porous plate 36 of the first degassing chamber S1, which will be described later, of the side wall portion 22*a*. Further, an air inflow port 22*f* leading to a discharge portion of the first degassing device 20 and a second air outflow port 22*g* leading to a suction portion of the second degassing device 21 are provided in a portion corresponding to a second degassing chamber S2, which will be described later, of the side wall portion 22*a*. The second air outflow port 22*g* is arranged above the air inflow port 22*f*.

The top wall portion 22*b* is provided with an introduction port 22*h* for cooling water. The introduction port 22*h* leads to the cooling tower 8 (refer to FIG. 1), where cooling water sent from the cooling tower 8 is introduced into the housing 22 through the introduction port 22*h*.

The bottom wall portion 22*c* is provided with an exhaust port 22*i*. The exhaust port 22*i* leads to the second pump 12 (refer to FIG. 1). Therefore, cooling water and water generated by condensing the water vapor are combined and exhausted from the exhaust port 22*i* and these water is sent to the cooling tower 8 by the second pump 12.

The partition portion 24 divides a space in the housing 22 into the first degassing chamber S1 and the second degassing chamber S2, and the partition portion 24 is arranged in an upper space of the housing 22 in a substantially horizontal state. The first degassing chamber Si is disposed in a space below the partition portion 24. Meanwhile, the second degassing chamber S2 is disposed in a space above the partition portion 24. That is, the second degassing chamber S2 is arranged above the first degassing chamber S1 across the partition portion 24. The first degassing chamber Si communicates with the vapor inflow port 22*d*, where water vapor discharged from the compressor 16 is introduced into the first degassing chamber S1. Meanwhile, the second degassing chamber S2 communicates with the introduction port 22*h*, where cooling water introduced from the introduction port 22*h* flows into the first degassing chamber S1 via the second degassing chamber S2.

The partition portion 24 is also provided with a plurality of passing portion coupling holes 24*a* for coupling inner tubes 26*a*, which will be described later, of the plurality of the passing portions 26, and a bypass portion coupling hole 24*b* for coupling an inner tube 30*a*, which will be described later, of the bypass portion 30.

The plurality of the passing portion 26 permits cooling water to flow from the second degassing chamber S2 to the first degassing chamber Sl, being arranged in the housing 22 with a predetermined interval on the circumference using an axial center of the housing 22 as a center. The first degassing chamber Si is separated from the second degassing chamber S2 by the cooling water in the passing portions 26. Each of the passing portions 26 has a pressure head space for containing a specified volume of cooling water so as to absorb a variation in a pressure difference between the first degassing chamber 51 and the second degassing chamber S2.

To be more specific, each of the passing portions 26 is configured by the internal tube 26*a* and an external tube 26*b*.

The internal tube 26*a* is made of a circular tube extending in the vertical direction, and an upper end portion thereof is coupled with the passing portion coupling hole 24*a* corresponding to the internal tube 26*a*. Therefore, cooling water introduced into the second degassing chamber S2 flows into the internal tube 26*a* from an opening of the upper end portion of the internal tube 26*a*. That is, the opening of the upper end portion of the internal tube 26*a* is made to be a passing portion inflow port 26*c* for permitting cooling water to flow into the passing portion 26 from the second degassing chamber S2.

The external tube 26*b* is made of a bottomed circular tube extending in the vertical direction, being externally inserted onto the internal tube 26*a*. The external tube 26*b* has an internal diameter which is larger than an external diameter of the internal tube 26*a*, being arranged in a state of having a gap between an external surface of the internal tube 26*a* and an internal surface of the external tube 26*b*. An upper end portion of the external tube 26*b* is arranged in a position adjacent to a lower surface of the partition portion 24 in the first degassing chamber S1. An opening between the upper end portion of the external tube 26*b* and the external surface of the internal tube 26*a* is made to be a passing portion outflow port 26*d* for permitting cooling water to flow out from the passing portion 26 to the first degassing chamber S1.

A predetermined interval is provided between the bottom of the external tube 26*b* and a lower end of the internal tube 26*a*. A flow channel 26*f* of cooling water is formed in the external tube 26*b* and the internal tube 26*a*. The flow channel 26*f* is configured to permit cooling water to flow to the passing portion outflow port 26*d* by passing through the internal tube 26*a* from the passing portion inflow port 26*c*, and further passing through the gap between the external surface of the internal tube 26*a* and the internal surface of the external tube 26*b* via the gap between the lower end of the internal tube 26*a* and the bottom of the external tube 26*b* disposed in a position lower than the passing portion outflow port 26*d*.

The first degassing chamber S1 is separated from the second degassing chamber S2 by the cooling water flowing in the flow channel 26*f*. The pressure head space is constituted in the flow channel 26*f*. The pressure head space contains a specified volume of cooling water so as to absorb a variation in a pressure difference between the first degassing chamber Si and the second degassing chamber S2. Even if a pressure difference is increased between the first degassing chamber S1 and the second degassing chamber S2, the increase of the pressure difference is absorbed by the cooling water contained in the pressure head space so as to suppress removal of cooling water for separating the first degassing chamber S1 and the second degassing chamber S2 in the flow channel 26*f*.

That is, when the temperature is decreased in the first degassing chamber Si due to a driving state of the compressor 16 or other causes, pressure in the first degassing chamber Si is decreased and a pressure difference is increased between the first degassing chamber S1 and the second degassing chamber S2. In this case, cooling water accumulated on the partition portion 24 is removed due to a decreased water level of the cooling water in the second degassing chamber S2, so that a water surface of cooling water in the internal tube 26*a* is pushed down, as shown in FIG. 3. In this case, the pressure head of cooling water in the flow channel 26*f* corresponding to a height difference between a water surface of cooling water in the internal tube 26*a* and the passing portion outflow port 26*d* is used to permit the increase of a pressure difference between the first degassing chamber S1 and the second degassing chamber S2 until the water surface of the cooling water is pushed down to or below the lower end of the internal tube 26*a*, so that the cooling water for separating the first degassing chamber S and the second degassing chamber S2 is retained in the flow channel 26*f*.

The dispersion plate 28 is provided so that cooling water which flows into the first degassing chamber S1 from the passing portion outflow ports 26*d* by passing through the flow channels 26*f* of the passing portions 26 from the second degassing chamber S2 is dispersed and shed in the first degassing chamber S1 in a wide range. The dispersion plate 28 is provided horizontally in a position adjacent to the lower surface of the partition portion 24 in the first degassing chamber S1. The dispersion plate 28 is provided with through holes in positions corresponding to each of the passing portions 26 and the bypass portion 30 respectively. The external tubes 26*b* of the passing portions 26 and an internal tube 30*a*, which will be described later, of the bypass portion 30 are inserted and fitted to correspond to the respective through holes.

The bypass portion 30 permits cooling water to flow from a position lower than the air inflow port 22*f* in the second degassing chamber S2 to the first degassing chamber S1, being arranged in the housing 22 in a position corresponding to the axial center of the housing 22. As shown in FIG. 4, the bypass portion 30 releases cooling water to the first degassing chamber S1 before a water surface of the cooling water reaches the air inflow port 22*f* and prevents cooling water from flowing back to the first degassing device 20 from the air inflow port 22*f* when the water surface of the cooling water accumulated on the partition portion 24 in the second degassing chamber S2 rises due to a decreased pressure difference between the first degassing chamber S1 and the second degassing chamber S2.

To be more specific, the bypass portion 30 is configured by the internal tube 30*a* and an external tube 30*b*.

The internal tube 30*a* is made of a circular tube extending in the vertical direction. The internal tube 30*a* is inserted and fitted into the bypass portion coupling hole 24*b* of the partition portion 24, and arranged in a state that an upper end portion thereof is protruded upward from an upper surface of the partition portion 24. An opening of the upper end portion of the internal tube 30*a* is made to be a bypass portion inflow port 30*c* for permitting cooling water to flow into the bypass portion 30 from the second degassing chamber S2. The bypass portion inflow port 30*c* is arranged in a position lower than the air inflow port 22*f*, and arranged in a position higher than a water surface of cooling water accumulated on the partition portion 24 in a normal driving state of the cooling device.

The external tube 30*b* is made of a bottomed circular tube extending in the vertical direction, and externally inserted onto the internal tube 30*a*. The external tube 30*b* has an internal diameter which is larger than an external diameter of the internal tube 30*a*, being arranged in a state of having a gap between an external surface of the internal tube 30*a* and an internal surface of the external tube 30*b*. An upper end portion of the external tube 30*b* is coupled with a through hole, which will be described later, of the third porous plate 36 in the first degassing chamber S1. An opening between the upper end portion of the external tube 30*b* and the external surface of the internal tube 30*a* is made to be a bypass portion outflow port 30*d* for permitting cooling water to flow out from the bypass portion 30 to the first degassing chamber S1.

A predetermined interval is provided between the bottom of the external tube 30*b* and a lower end of the internal tube 30*a*. A bypass portion flow channel 30*f* is formed in the external tube 30*b* and the internal tube 30*a*. The bypass portion flow channel 30*f* is configured to permit cooling water to flow to the bypass portion outflow port 30*d* by passing through the internal tube 30*a* from the bypass portion inflow port 30*c*, and further passing through the gap between the external surface of the internal tube 30*a* and the internal surface of the external tube 30*b* via the gap between the lower end of the internal tube 30*a* and the bottom of the external tube 30*b* disposed in a position lower than the bypass portion outflow port 30*d*.

The first degassing chamber S1 is separated from the second degassing chamber S2 by the cooling water flowing in the bypass portion flow channel 30*f*. A pressure head space is constituted in the bypass portion flow channel 30*f*. The pressure head space contains a specified volume of cooling water so as to absorb a variation in a pressure difference between the first degassing chamber S1 and the second degassing chamber S2. Even if a pressure difference is increased between the first degassing chamber S1 and the second degassing chamber S2, the increase of the pressure difference is absorbed by the cooling water contained in the pressure head space of the bypass portion flow channel 30*f* so as to suppress removal of cooling water for separating the first degassing chamber 51 and the second degassing chamber S2 in the bypass portion flow channel 30*f*. This principle is similar to that of the passing portions 26, where the pressure head of cooling water in the bypass portion flow channel 30*f* corresponding to a height difference between a water surface of cooling water in the internal tube 30*a* and the bypass portion outflow port 30*d* is used to permit the increase of a pressure difference between the first degassing chamber 51 and the second degassing chamber S2 until the water surface of the cooling water is pushed down to or below the lower end of the internal tube 30*a*, so that cooling water for separating the first degassing chamber S1 and the second degassing chamber S2 is retained in the bypass portion flow channel 30*f*.

The first porous plate 32 is provided horizontally with a predetermined interval above the partition portion 24 in the second degassing chamber S2. Cooling water introduced into the second degassing chamber S2 through the introduction port 22*h* is accumulated on the first porous plate 32 while pouring down onto the partition portion 24 by turning into showers through a number of fine holes provided in the first porous plate 32.

The second porous plate 34 is provided horizontally in a position adjacent to a lower surface of the dispersion plate 28 in the first degassing chamber S1. Cooling water transmitted through the dispersion plate 28 is accumulated on the second porous plate 34 while pouring down in a shower form by passing through a number of fine holes provided in the second porous plate 34. Through holes are provided in the second porous plate 34 in positions corresponding to each of the passing portions 26 and the bypass portion 30 respectively. The external tubes 26*b* of the passing portions 26 and the internal tube 30*a* of the bypass portion 30 are inserted and fitted to correspond to the respective through holes.

The third porous plate 36 is provided horizontally with an interval below the second porous plate 34 in the first degassing chamber S1. Cooling water transmitted through the second porous plate 34 is accumulated on the third porous plate 36 while pouring down by turning into finer showers through a number of fine holes provided in the third porous plate 36. The third porous plate 36 is provided with through holes in positions corresponding to each of the passing portions 26 and the bypass portion 30 respectively. The external tubes 26*b* of the passing portions 26 are inserted and fitted to correspond the respective through holes while the upper end portion of the external tube 30*b* of the bypass portion 30 is coupled with the through hole.

The third porous plate 36 is also provided with a water level control portion 36*a* for preventing cooling water accumulated on the third porous plate 36 from flowing into the suction port of the first degassing device 20. The water level control portion 36*a* is made of a cylinder extending in the vertical direction, and a lower end portion thereof is coupled with the through hole provided in the third porous plate 36. That is, upper and lower spaces of the third porous plate 36 communicate by an internal space of the water level control portion 36*a*. An upper end portion of the water level control portion 36*a* is arranged in a position lower than the first air inflow port 22*e*. Therefore, cooling water exceeding the upper end portion of the water level control portion 36*a* is released to the lower space of the third porous plate 36 by passing through the water level control portion 36*a*. Accordingly, even if a water level of cooling water accumulated on the third porous plate 36 rises, it does not rise to exceed the upper end portion of the water level control portion 36*a*, so that cooling water is prevented from flowing into the suction port of the first degassing device 20 through the first air outflow port 22*e*.

The mesh member 38 is arranged horizontally with an interval below the third porous plate 36 in the first degassing chamber S1. Cooling water transmitted through the third porous plate 36 is shed by turning into finer droplets or mist through mesh of the mesh member 38. Water vapor flowing into the first degassing chamber Si from the compressor 16 through the vapor inflow port 22*d* is made to adhere to droplet or misty cooling water which is transmitted and shed through the mesh member 38 in order to condense the vapor.

The first degassing device 20 degasses and condenses air from the first degassing chamber S1, and discharges the air to the second degassing chamber S2. To be more specific, the first degassing device 20 has a Roots blower 20*a* and a first degassing tower 20*b*. A suction portion of the Roots blower 20*a* leads to the first air outflow port 22*e* of the housing 22 via the first degassing tower 20*b*, while a discharge portion of the Roots blower 20*a* leads to the air inflow port 22*f* of the housing 22. Air in the first degassing chamber Si is degassed by a suction effect of the Roots blower 20*a* through the first air outflow port 22*e*, and the air is sent into the first degassing tower 20*b*. Cooling water is sprayed from upward in the first degassing tower 20*b*, where water contained in air sent from the first degassing chamber S1 is made to adhere to the cooling water and removed. Therefore, partial pressure of air degassed from the first degassing chamber S1 rises in the first degassing tower 20*b*. The Roots blower 20*a* sucks and compresses air from the first degassing tower 20*b*, and discharges the air to the second degassing chamber S2 through the air outflow port of the housing 22. Air degassed from the first degassing chamber Si is thus concentrated and discharged to the second degassing chamber S2 by the first degassing device 20.

The second degassing device 21 degasses and concentrates air from the second degassing chamber S2, and evacuates the air externally. To be more specific, the second degassing device 21 has a vacuum pump 21*a* and a second degassing tower 21*b*. A suction portion of the vacuum pump 21*a* leads to the second air outflow port 22*g* of the housing 22 via the second degassing tower 21*b*, while a discharge portion of the vacuum pump 21*a* leads to an external evacuation path. Air in the second degassing chamber S2 is degassed by a suction effect of the vacuum pump 21*a* through the second air outflow port 22*g*, and the air is sent into the second degassing tower 21*b*. In the second degassing tower 21*b*, cooling water is sprayed from upward, and water contained in air sent from the second degassing chamber S2 is made to adhere to the cooling water and removed. Therefore, partial pressure of air degassed from the second degassing chamber S2 rises in the second degassing tower 21*b*. The vacuum pump 21*a* sucks and compresses air from the second degassing tower 21*b*, and externally evacuates the air through the evacuation path. Air degassed from the second degassing chamber S2 is thus concentrated and evacuated externally by the second degassing device 21.

Operation in the condenser 18 according to the present embodiment when water vapor sent from the compressor 16 is condensed will be explained.

Water vapor sent from the compressor 16 flows into the first degassing chamber S1 in the housing 22 of the condenser 18 through the vapor inflow port 22*d*.

Cooling water is introduced into the housing 22 of the condenser 18 through the introduction port 22*h*, where the cooling water is accumulated on the first porous plate 32 in the second degassing chamber S2 while pouring down on the partition port 24 in a shower form by being transmitted through the first porous plate 32. Cooling water on the partition portion 24 flows into each of the passing portions 26 through the passing portion inflow ports 26*c*, and flows out onto the dispersion plate 28 in the first degassing chamber Si from the passing portion outflow ports 26*d* by passing through the flow channels 26*f* of the respective passing portions 26. Cooling water flowing out onto the dispersion plate 28 is dispersed in the entire horizontal direction of the first degassing chamber S1 by the dispersion plate 28, and transmitted through the dispersion plate 28 so as to flow downward. Thereafter, cooling water is transmitted through the second porous plate 34 and the third porous plate 36 so as to pour down in a shower form, and transmitted and shed through the mesh member 38 by turning into finer droplets or mist. Water vapor flowing into the first degassing chamber Si is made to adhere to the droplet or misty cooling water and condensed. Cooling water and water generated by condensing the water vapor is combined and shed so as to be exhausted from the housing 22 through the exhaust port 22*i*.

In the first degassing device 20, air in the first degassing chamber S1 is degassed and water is removed out of the degassed air in the first degassing tower 20*b*, followed by compressing the air by the Roots blower 20*a* and discharging condensed air to the second degassing chamber S2. Therefore, air contained in cooling water pouring down in the first degassing chamber S1 is reduced. When water vapor is made to adhere to cooling water and condensed, air contained in the cooling water becomes a hindrance of the condensation, but the hindrance of condensation of the water vapor is thus suppressed by reducing air contained in cooling water.

In the second degassing device 21, air in the second degassing chamber S2 is degassed and water is removed from the degassed air in the second degassing tower 21*b*, followed by compressing air by the vacuum pump 21*a* and externally exhausting condensed air through an exhaust path. Therefore, air contained in cooling water which is transmitted through the first porous plate 32 and pours down in the second degassing chamber S2 is reduced.

The temperatures of water vapor discharged from the compressor 16 into the housing 22 of the condenser 18 fluctuates due to a driving state of the compressor 16 or other causes, and the temperature fluctuates in the first degassing chamber S1 accordingly. If the temperature is decreased in the first degassing chamber S1 for example, pressure in the first degassing chamber S1 is decreased and a pressure difference is increased accordingly between the first degassing chamber S1 and the second degassing chamber S2. In this case, a water level of cooling water accumulated on the partition portion 24 is decreased in the second degassing chamber S2, and a water surface of cooling water is pushed down in the internal tubes 26*a* of the passing portions 26 as shown in FIG. 3. At this time, the increase of the pressure difference between the first degassing chamber Si and the second degassing chamber S2 is absorbed by the cooling water contained in the pressure head spaces of the flow channels 26*f* of the passing portions 26, so that cooling water for separating the first degassing chamber S1 and the second degassing chamber S2 from one another is retained in the flow channels 26*f*.

Meanwhile, if the temperature rises in the first degassing chamber S1, pressure in the first degassing chamber S1 rises and a pressure difference is decreased accordingly between the first degassing chamber Si and the second degassing chamber S2. In this case, a water level of cooling water accumulated on the partition portion 24 rises in the second degassing chamber S2 as shown in FIG. 4. When cooling water accumulated on the partition portion 24 exceeds the bypass portion inflow port 30*c* of the bypass portion 30, the exceeded cooling water flows into the bypass portion 30 and flows out onto the third porous plate 36 in the first degassing chamber S1 from the bypass portion outflow port 30*d* by passing through the bypass portion flow channel 30*f*. Therefore, cooling water is prevented from flowing back to the first degassing device 20 through the air inflow port 22*f* in the second degassing chamber S2. Moreover, even if a pressure difference is increased between the first degassing chamber S1 and the second degassing chamber S2 as stated above, the increase of the pressure difference is absorbed by the cooling water contained in the pressure head space of the bypass portion flow channel 30*f*, so that cooling water for separating the first degassing chamber S1 and the second degassing chamber S2 is retained in the bypass portion flow channel 30*f*.

As explained above, the first degassing chamber S1 is separated from the second degassing chamber S2 by the cooling water in the passing portions 26, and each of the passing portions 26 has the pressure head space for containing a specified volume of cooling water so as to absorb a variation in a pressure difference between the first degassing chamber S1 and the second degassing chamber S2 in the present embodiment. Therefore, even if the pressure difference is increased between the first degassing chamber 1 and the second degassing chamber S2, the increase of the pressure difference is absorbed by the cooling water contained in the pressure head spaces of the passing portions 26, so that removal of cooling water for separating the first degassing chamber S1 and the second degassing chamber S2 from one another can be suppressed. Accordingly, it is possible in the present embodiment to prevent communication between the first degassing chamber S1 and the second degassing chamber S2 even if a pressure difference is increased between the first degassing chamber S1 and the second degassing chamber S2 which are separated by cooling water.

The dispersion plate 28 is also provided in the present embodiment in order to disperse and shed cooling water flowing out from the passing portion outflow ports 26*d* of the passing portions 26 into the first degassing chamber S1, so that cooling water flowing out from the passing portions 26 into the first degassing chamber S1 can be dispersed and shed in the first degassing chamber Si in a wide range without shedding the cooling water only in a range adjacent to the passing portion outflow ports 26*d*. Therefore, it is possible to enhance condensation efficiency of water vapor sent from the compressor 16 to the condenser 18.

Moreover, the bypass portion 30 is provided in the second degassing chamber S2 of the present embodiment in order to permit cooling water to flow into the first degassing chamber S1 from a position lower than the air inflow port 22*f* leading to the discharge portion of the first degassing. device 20. Therefore, even if a pressure difference is reduced between the first degassing chamber S1 and the second degassing chamber S2 and a water surface of cooling water rises in the second degassing chamber S2, the cooling water can be released to the first degassing chamber Si through the bypass portion 30 before the water surface of the cooling water reaches the air inflow port 22*f*. Accordingly, even if a pressure difference is reduced between the first degassing chamber S1 and the second degassing chamber S2, cooling water can be prevented from flowing back to the first degassing device 20 from the air inflow port 22*f*.

Furthermore, the first degassing chamber S1 is separated from the second degassing chamber S2 by the cooling water in the bypass portion 30, and the bypass portion 30 has the pressure head space for containing a specified volume of cooling water so as to absorb a variation in a pressure difference between the first degassing chamber 51 and the second degassing chamber S2. Therefore, even if the pressure difference is increased between the first degassing chamber S1 and the second degassing chamber S2, the increase of the pressure difference is absorbed by the cooling water contained in the pressure head space of the bypass portion 30, so that cooling water for separating the first degassing chamber S1 and the second degassing chamber S2 from one another can be retained in the bypass portion 30. Accordingly, even if a pressure difference is increased between the first degassing chamber S1 and the second degassing chamber S2, it is possible to prevent communication between the first degassing chamber S1 and the second degassing chamber S2 through the bypass portion flow channel 30*f*.

The embodiment disclosed here should be considered as being entirely exemplary and unlimited. A range of the present invention is not indicated by the above explanation of the embodiment, but by a range of claims, where changes made within a meaning and range equal to the range of the claims are entirely included in the present invention.

For example, each of the passing portions 26 for permitting cooling water to flow from the second degassing chamber S2 to the first degassing chamber S1 is provided in the housing 22 and configured by a double tube including the internal tube 26*a* and the external tube 26*b* in the present embodiment, but it is not limited in the present invention and the passing portion may be arranged in the outside of the housing 22 in a configuration of a U tube.

The bypass portion 30 is also arranged in the housing 22 and configured by a double tube including the internal tube 30*a* and the external tube 30*b* in the present embodiment, but it is not limited in the present invention and the bypass portion may be arranged in the outside of the housing 22 in a configuration of a U tube.

Moreover, a device to which the condenser 18 is applied is not limited to , the cooling device as explained above in the present embodiment.

(Outline of the Present Embodiment)

The present embodiment is summarized as follows.

The condenser according to the present embodiment includes: the housing having the vapor inflow port connectable to the discharge portion of the compressor, the first degassing chamber, in the housing, communicating with the vapor inflow port, and the second degassing chamber, in the housing, arranged above the first degassing chamber across the partition portion; the first degassing device for degassing and concentrating air from the first degassing chamber and discharging the concentrated air to the second degassing chamber; and the second degassing device for degassing and concentrating air from the second degassing chamber and externally discharging the concentrated air, the condenser shedding a cooling fluid in the first degassing chamber via the second degassing chamber in the housing and causing vapor flowing into the first degassing chamber through the vapor inflow port to adhere to the cooling fluid so as to condense the vapor, wherein the condenser includes the passing portion for permitting the cooling fluid to flow from the second degassing chamber to the first degassing chamber; the first degassing chamber is separated from the second degassing chamber by the cooling fluid in the passing portion, and the passing portion has a pressure head space for containing a specified volume of cooling fluid so as to absorb a variation in a pressure difference between the first degassing chamber and the second degassing chamber.

In this condenser, since the first degassing chamber is separated from the second degassing chamber by the cooling fluid in the passing portion, and the passing portion has the pressure head space for containing a specified volume of cooling fluid so as to absorb a variation in a pressure difference between the first degassing chamber and the second degassing chamber, even if a pressure difference is increased between the first degassing chamber and the second degassing chamber, the increase of the pressure difference is absorbed by the cooling fluid contained in the pressure head space of the passing portion, so that removal of the cooling fluid for separating the first degassing chamber and the second degassing chamber from one another can be suppressed. Accordingly, even if a pressure difference is increased between the first degassing chamber and the second degassing chamber which are separated by the cooling fluid, communication between the degassing chambers can be prevented in the condenser.

As a detailed configuration of the above condenser, the passing portion preferably includes: the passing portion inflow port for permitting the cooling fluid to flow into the passing portion from the second degassing chamber; the passing portion outflow port for permitting the cooling fluid to flow out into the first degassing chamber from the passing portion; and the flow channel for permitting the cooling fluid to flow from the passing portion inflow port to the passing portion outflow port via a predetermined position lower than the passing portion outflow port.

The above condenser preferably includes the dispersion plate for dispersing and shedding a cooling fluid flowing from the passing portion into the first degassing chamber.

According to this configuration, a cooling fluid flowing from the passing portion into the first degassing chamber can be dispersed and shed in the first degassing chamber in a wide range without shedding the cooling fluid only in a range adjacent to the passing portion outflow port, so that efficiency of vapor concentration can be enhanced.

In the above condenser, it is preferable that the housing is provided with the air inflow port for causing air discharged from the first degassing device to flow into the second degassing chamber and the condenser further includes the bypass portion for causing the cooling fluid to flow from a position lower than the air inflow port in the second degassing chamber into the first degassing chamber.

According to this configuration, even if a pressure difference is decreased between the first degassing chamber and the second degassing chamber so that a fluid surface of a cooling fluid rises in the second degassing chamber, the cooling fluid can be released to the first degassing chamber through the bypass portion before the fluid surface of the cooling fluid reaches the air inflow port. Therefore, even if a pressure difference is decreased between the degassing devices, a cooling fluid can be prevented from flowing back to the first degassing device through the air inflow port.

In this case, the first degassing chamber is preferably separated from the second degassing chamber by the cooling fluid in the bypass portion, and the bypass portion preferably has a pressure head space for containing a specified volume of cooling fluid so as to absorb a variation in a pressure difference between the first degassing chamber and the second degassing chamber.

According to this configuration, even if a pressure difference is increased between the first degassing chamber and the second degassing chamber, the increase of the pressure difference can be absorbed by the cooling fluid contained in the pressure head space of the bypass portion, so that the cooling fluid for separating the first degassing chamber and the second degassing chamber from one another can be retained in the bypass portion. Therefore, even if a pressure difference is increased between the first degassing chamber and the second degassing chamber, it is possible to prevent communication between the degassing chambers through the bypass portion.

As a detailed configuration in this case, the bypass portion preferably includes: the bypass portion inflow port for permitting a cooling fluid to flow into the bypass portion from the second degassing chamber; the bypass portion outflow port for permitting a cooling fluid to flow into the first degassing chamber from the bypass portion; and the bypass portion flow channel for permitting a cooling fluid to flow from the bypass portion inflow port to the bypass portion outflow port via a predetermined position lower than the bypass portion outflow port.

Moreover, the cooling device according to the present embodiment includes any one of the aforementioned condensers, the evaporator for evaporating at least part of a working fluid, and the compressor having the suction portion connected to the evaporator and the discharge portion connected to the vapor inflow port of the condenser in order to compress vapor generated in the evaporator and discharge the compressed vapor to the condenser, wherein cooling is performed by using evaporation heat obtained when at least part of the working fluid is evaporated.

Since the cooling device is provided with any one of the aforementioned condensers, even if a pressure difference is increased between the first degassing chamber and the second degassing chamber which are separated by a cooling fluid, an effect of suppressing communication between the degassing chambers, which is similar to that of the aforementioned condensers, can be obtained.

The invention claimed is:

1. A condenser comprising: a housing having a vapor inflow port connectable to a discharge portion of a compressor, a first degassing chamber, in the housing, communicating with the vapor inflow port, and a second degassing chamber, in the housing, arranged above the first degassing chamber across a partition portion; a first degassing device for degassing and concentrating air from the first degassing chamber and discharging the concentrated air to the second degassing chamber; and a second degassing device for degassing and concentrating air from the second degassing chamber and externally discharging the concentrated air, the condenser shedding a cooling fluid in the first degassing chamber via the second degassing chamber in the housing and causing vapor flowing into the first degassing chamber through the vapor inflow port to adhere to the cooling fluid so as to condense the vapor, wherein:

the condenser comprises a passing portion for permitting the cooling fluid to flow from the second degassing chamber to the first degassing chamber;

the first degassing chamber is separated from the second degassing chamber by the cooling fluid in the passing portion, and the passing portion has a pressure head space for containing a specified volume of cooling fluid so as to absorb a variation in a pressure difference between the first degassing chamber and the second degassing chamber.

2. The condenser according to claim 1, wherein the passing portion comprises: a passing portion inflow port for permitting the cooling fluid to flow into the passing portion from the second degassing chamber; a passing portion outflow port for permitting the cooling fluid to flow out into the first degassing chamber from the passing portion;

and a flow channel for permitting the cooling fluid to flow from the passing portion inflow port to the passing portion outflow port via a predetermined position lower than the passing portion outflow port.

3. The condenser according to claim 1, further comprising a dispersion plate for dispersing and shedding the cooling fluid flowing from the passing portion into the first degassing chamber.

4. The condenser according to claim 1, wherein:

the housing is provided with an air inflow port for causing air discharged from the first degassing device to flow into the second degassing chamber; and the condenser further comprises a bypass portion for causing the cooling fluid to flow from a position lower than the air inflow port in the second degassing chamber into the first degassing chamber.

5. The condenser according to claim 4, wherein the first degassing chamber is separated from the second degassing chamber by the cooling fluid in the bypass portion, and the bypass portion has a pressure head space for containing a specified volume of cooling fluid so as to absorb a variation in a pressure difference between the first degassing chamber and the second degassing chamber.

6. The condenser according to claim 5, wherein the bypass portion comprises: a bypass portion inflow port for permitting the cooling fluid to flow into the bypass portion from the second degassing chamber; a bypass portion outflow port for permitting the cooling fluid to flow into the first degassing chamber from the bypass portion; and a bypass portion flow channel for permitting the cooling fluid to flow from the bypass portion inflow port to the bypass portion outflow port via a predetermined position lower than the bypass portion outflow port.

7. A cooling device, comprising:

the condenser according to claim 1;

an evaporator for evaporating at least part of a working fluid; and a compressor having a suction portion connected to the evaporator and a discharge portion connected to the vapor inflow port of the condenser in order to compress vapor generated in the evaporator and discharge the compressed vapor to the condenser, wherein cooling is performed by using evaporation heat obtained when at least part of the working fluid is evaporated.

* * * * *